US009648712B2

(12) United States Patent
Nakamura et al.

(10) Patent No.: US 9,648,712 B2
(45) Date of Patent: May 9, 2017

(54) X-RAY RADIATION SOURCE

(71) Applicants: Futaba Corporation, Mobara-shi, Chiba (JP); HAMAMATSU PHOTONICS K.K., Hamamatsu-shi, Shizuoka (JP)

(72) Inventors: Tatsuya Nakamura, Hamamatsu (JP); Norimasa Kosugi, Hamamatsu (JP); Naoki Okumura, Hamamatsu (JP); Yoshitaka Sato, Mobara (JP); Akira Matsumoto, Mobara (JP); Yoshihisa Marushima, Mobara (JP); Kazuhito Nakamura, Mobara (JP)

(73) Assignees: Futaba Corporation, Mobara-shi, Chiba (JP); HAMAMATSU PHOTONICS K.K., Hamamatsu-shi, Shizuoka (JP)

( * ) Notice: Subject to any disclaimer, the term of this patent is extended or adjusted under 35 U.S.C. 154(b) by 90 days.

(21) Appl. No.: 14/763,949

(22) PCT Filed: Nov. 5, 2013

(86) PCT No.: PCT/JP2013/079921
§ 371 (c)(1),
(2) Date: Jul. 28, 2015

(87) PCT Pub. No.: WO2014/119079
PCT Pub. Date: Aug. 7, 2014

(65) Prior Publication Data

US 2015/0382440 A1 Dec. 31, 2015

(30) Foreign Application Priority Data

Jan. 29, 2013 (JP) ..... 2013-014175

(51) Int. Cl.
*H05G 1/10* (2006.01)
*H01J 35/06* (2006.01)
(Continued)

(52) U.S. Cl.
CPC ..... *H05G 1/10* (2013.01); *H01J 35/06* (2013.01); *H01J 35/08* (2013.01); *H01J 35/16* (2013.01); *H05G 1/06* (2013.01); *H01J 2235/087* (2013.01)

(58) Field of Classification Search
CPC .. H05G 2/00; H05G 1/06; H05G 1/02; H05G 1/10; H01J 35/16; H01J 35/18; H01J 2235/186; H01J 35/06; H01J 35/02
See application file for complete search history.

(56) References Cited

U.S. PATENT DOCUMENTS 6,426,998 B1 * 7/2002 Hell ..... H01J 35/305 378/127
2002/0085674 A1 * 7/2002 Price ..... A61B 6/032 378/122
(Continued)

FOREIGN PATENT DOCUMENTS

CN 101449629 6/2009
CN 102347187 2/2012
(Continued)

OTHER PUBLICATIONS

English-language translation of International Preliminary Report on Patentability (IPRP) dated Aug. 13, 2015 that issued in WO Patent Application No. PCT/JP2013/079921.

*Primary Examiner* — Hoon Song
(74) *Attorney, Agent, or Firm* — Drinker Biddle & Reath LLP

(57) ABSTRACT

In an X-ray radiation source, a counter wall made of alkali-containing glass, out of walls of a housing of an X-ray tube, is arranged opposite to a high-voltage region VH of a
(Continued)

power supply unit including a high-voltage generation module which generates a negative high voltage to be applied to a filament. This configuration prevents an electric field from being generated in the counter wall and thus suppresses precipitation of alkali ions from the glass. Therefore, it prevents change in potential relationship between electrodes at different potentials such as the filament, grid, and target and prevents occurrence of a trouble of failure in maintaining a desired X-ray amount, thus enabling stable operation to be maintained.

6 Claims, 11 Drawing Sheets

(51) Int. Cl.

| | |
|---|---|
| ***H01J 35/08*** | (2006.01) |
| ***H01J 35/16*** | (2006.01) |
| ***H05G 1/06*** | (2006.01) |

(56) References Cited

U.S. PATENT DOCUMENTS

| | | | | |
|---|---|---|---|---|
| 2006/0280290 | A1* | 12/2006 | Matsumura ..... | H01J 35/18 378/140 |
| 2012/0027179 | A1 | 2/2012 | Ogata et al. | |
| 2014/0270088 | A1* | 9/2014 | Camara ..... | H01J 35/06 378/140 |

FOREIGN PATENT DOCUMENTS

| | | | |
|---|---|---|---|
| JP | H09-45492 | A | 2/1997 |
| JP | 2002-352755 | A | 12/2002 |
| JP | 2007-066655 | A | 3/2007 |
| JP | 2007-305565 | A | 11/2007 |
| JP | 2012-049123 | A | 3/2012 |
| TW | 200746927 | | 12/2007 |

* cited by examiner (a)

(b)

X-RAY RADIATION SOURCE

TECHNICAL FIELD

The present invention relates to an X-ray radiation source.

BACKGROUND ART

There are the conventionally-developed X-ray radiation sources configured in the configuration wherein an X-ray tube, a high-voltage generation module, and others are incorporated in a housing having an X-ray radiation window. For example, in the industrial X-ray generation device described in Patent Literature 1, the high voltage side of a boost circuit and the cathode of the X-ray tube are arranged close to each other. For example, in the soft X-ray generation device described in Patent Literature 2, a thin film comprised of diamond grains with predetermined grain sizes is provided on the surface of an emitter. This device has the configuration wherein the whole housing of the X-ray tube is made of aluminum and wherein a metal member is located outside the surface where the cathode of the X-ray tube is arranged.

In the X-ray radiation sources as described above, it is conceivable to use alkali-containing glass, e.g., such as soda lime glass for a bottom plate of the housing or the like, from the viewpoint of matching the coefficient of thermal expansion thereof with that of power-supply terminals of the X-ray tube. Since the coefficient of thermal expansion of such glass is close to those of various electrodes and sealing materials arranged in the X-ray tube, it becomes feasible to form a vacuum housing with high vacuum maintaining performance.

CITATION LIST

Patent Literatures

Patent Literature 1: Japanese Patent Application Laid-open Publication No. 2012-49123

Patent Literature 2: Japanese Patent Application Laid-open Publication No. 2007-305565

SUMMARY OF INVENTION

Technical Problem

Incidentally, in the case where the alkali-containing glass is used for the housing of the X-ray tube, if the glass is sandwiched between a high-voltage part such as the cathode to which a negative high voltage is applied and a low-voltage part such as various control circuits to which a low voltage (or the ground potential) is applied, alkali ions can be attracted to the potential of the high-voltage part to precipitate from the glass. We found that when such precipitation of alkali ions occurred and the alkali ions adhered to the electrode or the like in the X-ray tube, the potential relationship between the electrodes could change and there was a risk of causing a trouble of failure in maintaining a desired X-ray amount.

The present invention has been accomplished in order to solve the above problem and it is an object of the present invention to provide an X-ray radiation source capable achieving stable operation by suppressing the precipitation of alkali ions from the housing.

Solution to Problem

In order to solve the above problem, an X-ray radiation source according to the present invention comprises: an X-ray tube having a cathode to which a negative high voltage is applied, a target generating X-rays with incidence of electrons from the cathode, and a housing that houses the cathode and the target and having an output window to output the X-rays generated from the target, to the outside; and a power supply unit generating the negative high voltage to be applied to the cathode, wherein the housing has a window wall provided with the output window, and a main body portion joined to the window wall to form a housing space for housing the cathode and the target, wherein the main body portion has a counter wall arranged opposite to the window wall and made of alkali-containing glass, and wherein the power supply unit has a high-voltage generation section to generate the negative high voltage, and a high-voltage region connected to the high-voltage generation section and where the counter wall is arranged.

In this X-ray radiation source, the counter wall made of the alkali-containing glass, out of the walls of the housing of the X-ray tube, is arranged in the high-voltage region connected to the high-voltage generation section generating the negative high voltage to be applied to the cathode. This configuration prevents an electric field from being generated in the counter wall and thus suppresses the precipitation of alkali ions from the glass. Therefore, it prevents the change in potential relationship between electrodes due to the adhesion of alkali ions and thus enables stable operation to be maintained, without occurrence of the trouble of failure in maintaining the desired X-ray amount.

Preferably, the cathode extends along an inner surface of the counter wall; and the high-voltage region extends along an extending direction of the cathode. When the cathode is arranged to extend, the precipitation of alkali ions from the counter wall becomes more likely to occur, but the precipitation of alkali ions can be suitably suppressed by arranging the high-voltage region so as to extend along the cathode.

Preferably, an electron emission portion of the cathode is separated from the counter wall; between the electron emission portion and the counter wall, a back electrode to which a negative high voltage substantially equal to the negative high voltage supplied to the cathode is applied from the power supply unit is provided; and the back electrode is arranged to extend along an inner surface of the counter wall so as to face the cathode. It is considered that if the electron emission portion is arranged to directly face the counter wall, the counter wall will be charged to make the potential unstable and also make emission of electrons unstable. Therefore, this trouble can be prevented by locating the back electrode so as to face the cathode. On the other hand, the precipitation of alkali ions from the counter wall becomes more likely to occur because of an electric field formed by the back electrode closer to the counter wall, but the precipitation of alkali ions can be more suitably suppressed while realizing stable electron emission, by locating the high-voltage region and the back electrode so as to face each other.

Preferably, the X-ray radiation source further comprises a circuit substrate on which the housing and the power supply unit are mounted, and comprising a wiring section to form the high-voltage region; and the high-voltage generation section and the wiring section are arranged so as to surround at least a part of the counter wall. This arrangement of the high-voltage generation section and the wiring section makes it feasible to more certainly prevent an electric field from being generated in the counter wall. In addition, it is feasible to achieve stable fixing of the X-ray tube.

Preferably, the X-ray radiation source further comprises a circuit substrate on which the housing and the power supply unit are mounted, and comprising a wiring section to form the high-voltage region; the housing is fixed to the circuit substrate through a spacer; and the high-voltage generation section and the wiring section are arranged so as to surround at least a part of the spacer between the housing and the circuit substrate, at a position opposite to the counter wall. This arrangement of the high-voltage generation section and the wiring section also makes it feasible to certainly prevent an electric field from being generated in the counter wall. In addition, while the X-ray tube is stably fixed by the spacer, the high-voltage generation section and the wiring section are arranged at the position opposite to the counter wall, thereby achieving effective utilization of the circuit substrate and downsizing of the device.

Preferably, the X-ray radiation source further comprises a circuit substrate on which the housing and the power supply unit are mounted, and comprising a wiring section to form the high-voltage region; and the high-voltage generation section and the wiring section are arranged on the opposite surface side to a mounted surface of the housing in the circuit substrate, at a position opposite to the counter wall. This arrangement of the high-voltage generation section and the wiring section also makes it feasible to certainly prevent an electric field from being generated in the counter wall. In addition, it simplifies the configuration around the housing and achieves downsizing of the device.

Advantageous Effect of Invention

The present invention has achieved the realization of stable operation by suppressing the precipitation of alkali ions from the housing.

DESCRIPTION OF EMBODIMENTS

The preferred embodiments of the X-ray radiation source according to the present invention will be described below in detail with reference to the drawings.

Figure 1:
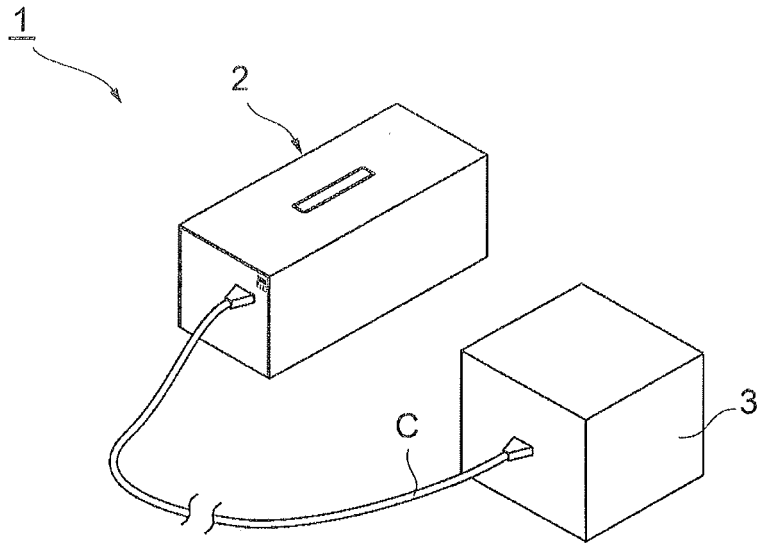
FIG. 1 is a perspective view showing an X-ray radiation device configured including the X-ray radiation source according to the first embodiment of the present invention.

FIG. 1 is a perspective view showing an X-ray radiation device configured including the X-ray radiation source according to the first embodiment of the present invention. The X-ray radiation device 1 shown in the same drawing is installed, for example, in a clean room or the like on a manufacturing line to handle large-scale glass, and is configured as a photoionizer (light irradiation type neutralization device) to remove static charges from large-scale glass by irradiation with X-rays. This X-ray radiation device 1 is configured with the X-ray radiation source 2 to radiate X-rays and a controller 3 to control the X-ray radiation source 2.

Figure 2:
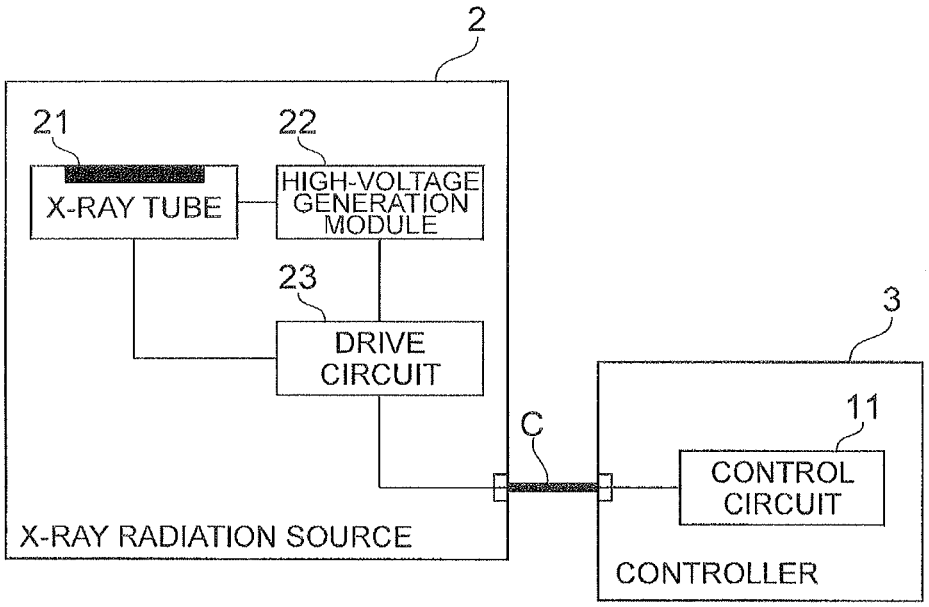
FIG. 2 is a block diagram showing functional constitutive elements of the X-ray radiation device shown in FIG. 1.

FIG. 2 is a block diagram showing functional constitutive elements of the X-ray radiation device 1. As shown in the same drawing, the controller 3 is configured including a control circuit 11. The control circuit 11 is configured, for example, including a power supply circuit to supply power to an X-ray tube 21 incorporated in the X-ray radiation source 2, a control signal transmitting circuit to transmit a control signal for controlling activation and deactivation to the X-ray tube 21, and so on. This control circuit 11 is connected to the X-ray radiation source 2 by a connection cable C.

Next, the configuration of the aforementioned X-ray radiation source 2 will be described in detail.

Figure 3:
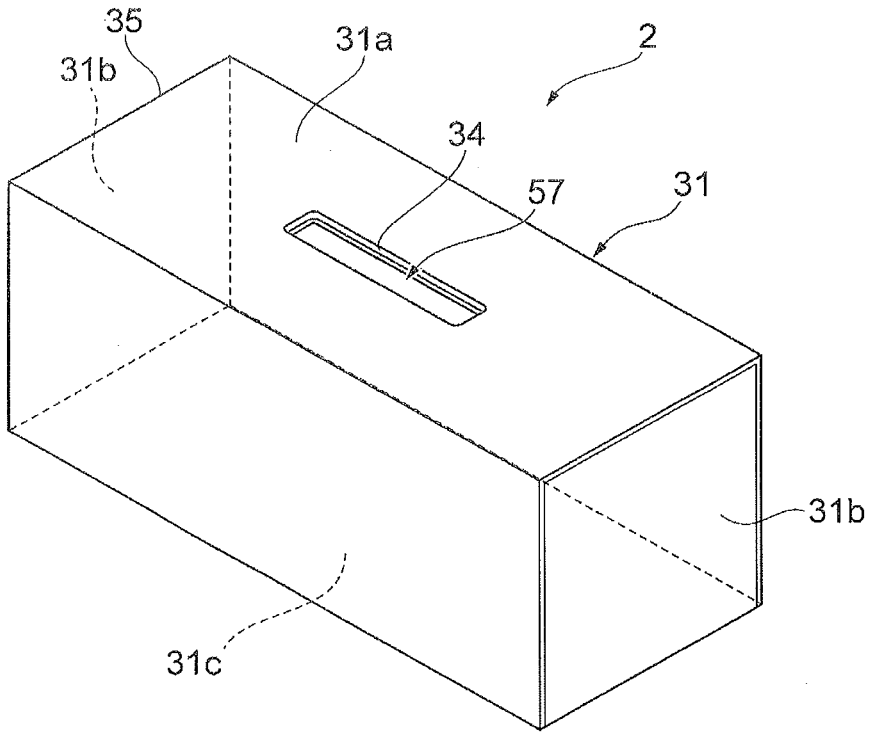
FIG. 3 is a perspective view of the X-ray radiation source shown in FIG. 1.
Figure 4:
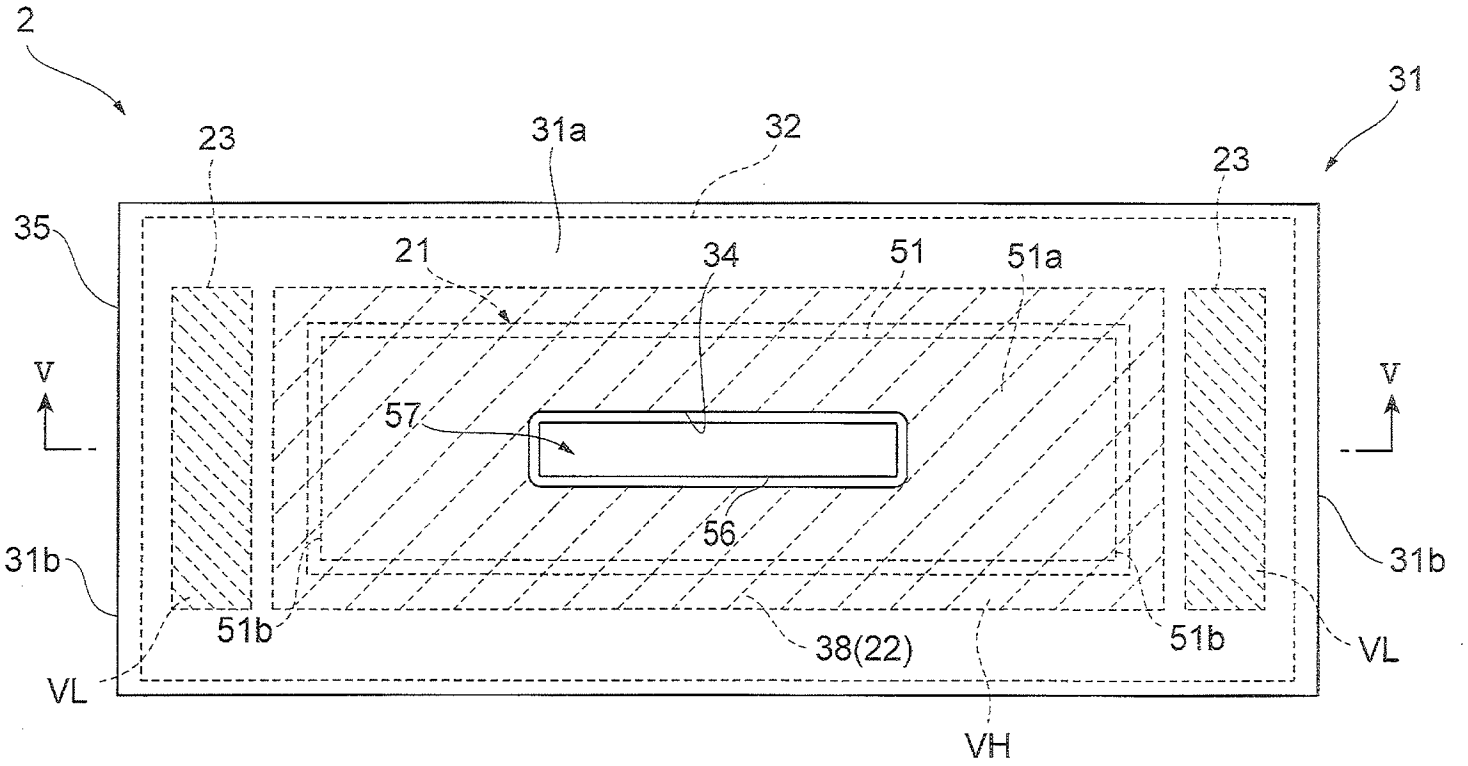
FIG. 4 is a plan view of FIG. 3.
Figure 5:
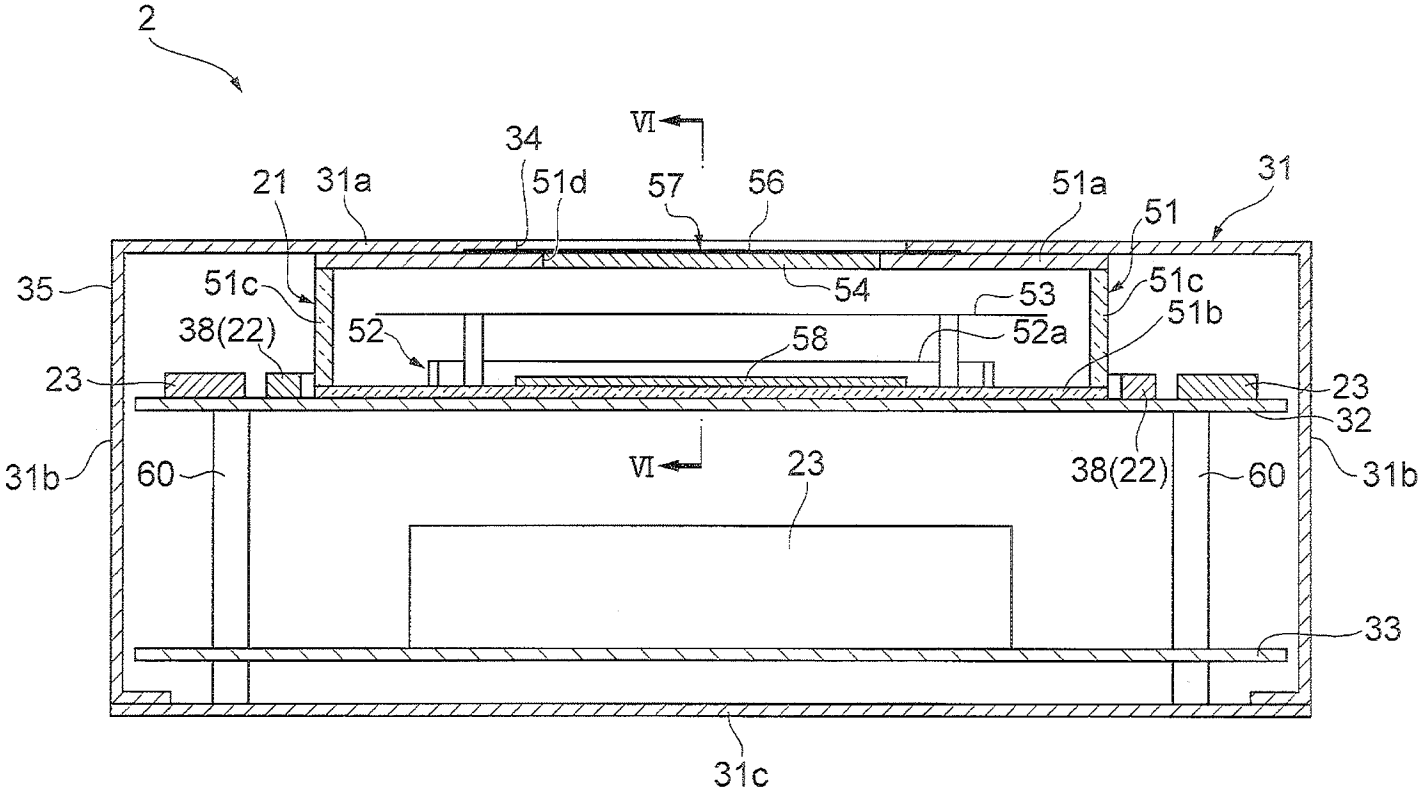
FIG. 5 is a cross-sectional view along the line V-V in FIG. 4.

FIG. 3 is a perspective view of the X-ray radiation source shown in FIG. 1. FIG. 4 is a plan view of FIG. 3 and FIG. 5 a cross-sectional view along the line V-V in FIG. 4. As shown in FIGS. 3 to 5, the X-ray radiation source 2 has the X-ray tube 21 and a high-voltage generation module (power supply unit, high-voltage generation section) 22, and a first circuit substrate 32 and a second circuit substrate 33 on each of which at least a portion of drive circuit 23 is mounted, in a housing 31 of a substantially rectangular parallelepiped shape made of metal.

The housing 31, as shown in FIGS. 3 and 4, is provided with a main body portion 35 which has a wall 31*a* of a rectangular shape with an X-ray output window 34 formed therein to output X-rays generated from the X-ray tube 21 to the outside, and side walls 31*b* provided on the respective sides of this wall 31*a*, while opening on one face side, and is also provided with a lid 31*c* opposed to the wall 31*a* and attached so as to close the opening of the main body portion 35. The X-ray output window 34 is comprised of an aperture formed in a rectangular shape along the longitudinal direction of the housing 31, in a substantially central region of the wall 31*a*.

The X-ray tube 21, as shown in FIG. 5, has a filament (cathode) 52 to generate an electron beam, a grid 53 to accelerate the electron beam, and a target 54 to generate X-rays in conjunction with incidence of the electron beam, in a housing 51 of a substantially rectangular parallelepiped shape sufficiently smaller than the housing 31. The housing 51 is provided with a window wall 51*a* which has an output window 57, and a main body portion which is joined to the window wall 51*a* to form a housing space for housing the filament 52, grid 53, and target 54. This main body portion is composed of a counter wall 51*b* opposed to the window wall 51*a*, and side walls 51*c* along the outer edges of the window wall 51*a* and the counter wall 51*b*. The window wall 51*a* is made, for example, of a metal plate of stainless steel or the like; The counter wall 51*b* is made, for example, of an insulating material such as glass containing alkali (sodium herein), e.g., soda lime glass or borosilicate glass. The side walls 51*c* are made, for example, of an insulating material such as glass.

The height of the side walls 51*c* is smaller than the longitudinal length of the window wall 51*a* and the counter wall 51*b*. Namely, the housing 51 is of a tabular, substantially rectangular parallelepiped shape such that the window wall 51*a* and the counter wall 51*b* can be regarded as a tabular surface. In a substantially central region of the window wall 51*a*, an aperture 51*d* slightly smaller than the X-ray output window 34 is formed in a rectangular shape along the longitudinal direction of the housing 51 (the longitudinal direction of the window wall 51*a* and the counter wall 51*b*). This aperture 51*d* constitutes the output window 57.

Figure 6:
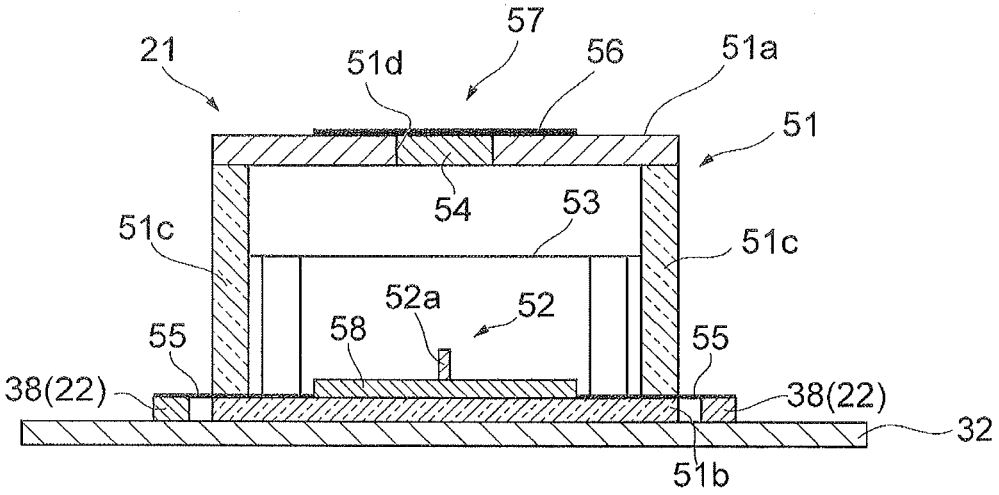
FIG. 6 is a cross-sectional view along the line VI-VI in FIG. 5.

The filament 52 is located on the counter wall 51*b* side and the grid 53 is located between the filament 52 and the target 54. The filament 52 and the grid 53 extend along the longitudinal direction of the housing 51 and a plurality of power supply pins 55 are connected to each of them, as shown in FIG. 6. The power supply pins 55 each pass between the side walls 51*c* and the counter wall 51*b* to project out to the two sides in the width direction of the housing 51 and are electrically connected to a wiring section 38 (described below) on the first circuit substrate 32. Applied to the filament 52 through the wiring section 38 and the power supply pins 55 is a negative high voltage, e.g. about −5 kV, from the high-voltage generation module 22, As shown in FIG. 5, an electron emission portion 52*a* of the filament 52 is separated from the counter wall 51*b* and a back electrode 58 is arranged so as to face the filament 52, between the electron emission portion 52*a* and the counter wall 51*b*. The back electrode 58 is formed in a rectangular shape with its longitudinal direction extending along the electron emission portion 52*a* of the filament 52 and with its transverse length sufficiently larger than the diameter of the filament 52 (cf. FIG. 6) and is arranged in a state in which it is mounted in close contact with the inner surface of the counter wall 51*b*. A plurality of power supply pins 55 different from the power supply pins 55 connected to the filament 52 are connected to the back electrode 58 and a negative high voltage, about −5 kV, is applied thereto from the high-voltage generation module 22 through the wiring section 38 and the power supply pins 55, as in the case of the filament 52.

On the other hand, a window material 56 of a rectangular shape made of a highly-radiotransparent and electroconductive material, e.g. titanium, is fixed in close contact to the outer surface side of the window wall 51*a* so as to seal the aperture 51*d*, as shown in FIG. 5, thereby constituting the output window 57 to output X-rays generated by the target 54 to the outside of the X-ray tube 21. The target 54 made, for example, of tungsten or the like is formed on the inner surface of the window material 56.

Arranged on the first circuit substrate 32, as shown in FIG. 4, are a part of the aforementioned drive circuit 23, and the high-voltage generation module 22 including the wiring section 38. The drive circuit 23 on the first circuit substrate 32 is arranged in regions of a substantially rectangular shape at two longitudinal ends of the first circuit substrate 32 so as to locate the X-ray tube 21 in between in the longitudinal direction. A voltage sufficiently smaller than the voltage applied to the X-ray tube 21 from the high-voltage generation module 22 is applied to the drive circuit 23, to form low-voltage regions VL on the first circuit substrate 32. As shown in FIG. 5, a part of the drive circuit 23 is also arranged on the second circuit substrate 33.

On the other hand, the high-voltage generation module 22 and the wiring section 38 constitute a part of the power supply unit in the present invention and, as shown in FIG. 4, while slightly separated from the X-ray tube 21, they are provided in a rectangular frame shape in a central region of the first circuit substrate 32 so as to surround the whole of the counter wall 51*b* of the housing 51. The negative high voltage is generated in the high-voltage generation module 22 and the wiring section 38 connected to the high-voltage generation module 22 is used as a power supply path, whereby a high-voltage region VH is formed in the rectangular frame and in an inside region thereof. The X-ray tube 21 is fixed to the first circuit substrate 32 so that the counter wall 51*b* of the housing 51 and the high-voltage region VH are opposed to each other, and the high-voltage region VH extends along the extending direction of the filament 52 in the housing 51, while facing the filament 52 and the back electrode 58 (cf. FIG. 5).

Spacer members 60 are adopted, as shown in FIG. 5, for fixing of the X-ray tube 21, high-voltage generation module 22, first circuit substrate 32, and second circuit substrate 33 in the housing 31. The spacer members 60 are formed, for example, of a ceramic in a rod shape and are not electrically conductive. The spacer members 60 are set upright on the inner surface side of the lid 31*c* in the housing 31 and support the first circuit substrate 32 with the X-ray tube 21 and the high-voltage generation module 22 mounted thereon and the second circuit substrate 33 with a part of the drive circuit 23 mounted thereon so as to be approximately parallel. The lid 31*c* provided with the foregoing structure is fixed to the main body portion 35 while the output window 57 of the X-ray tube 21 is positioned so as to be exposed from the X-ray output window 34 of the housing 31.

In the X-ray radiation source 2 having the configuration as described above, the counter wall 51*b* made of the alkali-containing glass, out of the walls of the housing 51 of the X-ray tube 21, is arranged opposite to the high-voltage region VH of the power supply unit including the high-voltage generation module 22 which generates the negative high voltage to be applied to the filament 52. This configuration prevents an electric field from being generated in the counter wall 51*b* and thus suppresses the precipitation of alkali ions from the glass.

If alkali ions precipitate from the glass, the problems as described below will arise. For example, if the alkali ion precipitates adhere to the surface of an insulating member such as the inner wall surface of the housing 51, the withstand voltage performance might degrade. This can also lead to degradation of withstand voltage performance between electrodes at different potentials, such as the filament 52, the grid 53, and the target 54, which can make it difficult to apply the voltages necessary for drive of the X-ray tube 21 between the electrodes. If the alkali ion precipitates adhere to the grid 53, a potential relationship with the filament 52 can change because of a difference between work functions of the material making up the grid 53 and the adhering alkali ions, which can make it difficult to stably extract electrons from the filament 52.

Therefore, as the counter wall 51*b* made of the alkali-containing glass is arranged opposite to the high-voltage region VH of the power supply unit including the high-voltage generation module 22 to generate the negative high voltage to be applied to the filament 52, it becomes feasible to suppress the change in the potential relationship between electrodes at different potentials, such as the filament 52, the grid 53, and the target 54, and to maintain the stable operation, without causing the trouble of failure in maintaining the desired X-ray amount. If the alkali ion precipitates adhere to the filament 52, the surface condition of the filament 52 will change, so as to lead to a possibility of change in electron emission capability as well; however, this problem can also be avoided by suppressing the precipitation of alkali ions from the glass.

In the X-ray radiation source 2, the electron emission portion 52*a* of the filament 52 is separated from the counter wall 51*b* and, the back electrode 58 to which the negative high voltage approximately equal to the negative high voltage supplied to the filament 52 is applied from the high-voltage generation module 22 is arranged to extend along the inner surface of the counter wall 51*b* so as to face the filament 52, between the electron emission portion 52*a* and the counter wall 51*b*. Furthermore, the high-voltage region VH extends along the extending direction of the filament 52 so as to face the back electrode 58.

It is considered that when the electron emission portion 52*a* is arranged to directly face the counter wall 51*b*, the counter wall 51*b* can be charged to make the potential unstable and also make the emission of electrons unstable. Therefore, this problem can be prevented by locating the back electrode 58 so as to face the filament 52. On the other hand, the precipitation of alkali ions from the counter wall 51*b* becomes more likely to occur by an electric field generated by the back electrode 58 closer to the counter wall 51*b* than the filament 52. Then, the present embodiment is so arranged that the high-voltage region VH and the back electrode 58 are arranged to face each other, whereby the precipitation of alkali from the counter wall 51*b* can be more certainly suppressed, while realizing stable electron emission.

In the X-ray radiation source 2, preferably, the high-voltage generation module 22 and the wiring section 38 forming the high-voltage region VH are arranged so as to surround the whole of the counter wall 51*b* on the first circuit substrate 32. This arrangement of the high-voltage generation module 22 and wiring section 38 makes the counter wall 51*b* more certainly arranged in the high-voltage region VH and thus more certainly prevents an electric field from being generated in the counter wall 51*b*. The X-ray tube 21 is fixed to the first circuit substrate 32, whereby it is feasible to realize stable fixing of the X-ray tube 21 in the X-ray radiation source 2.

Figure 7:
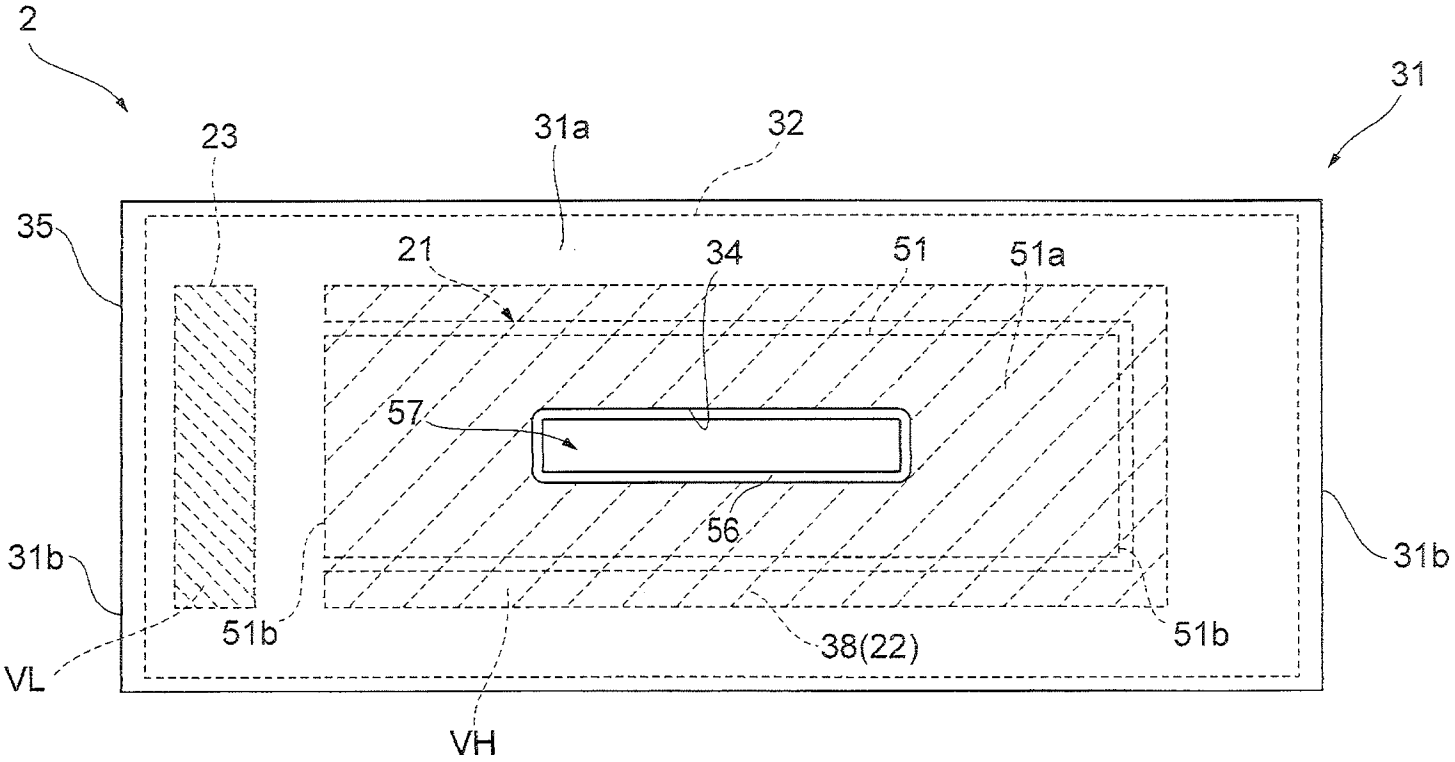
FIG. 7 is a plan view showing the X-ray radiation source according to a modification example.

It should be noted that the high-voltage generation module 22 and wiring section 38 do not always have to be arranged to surround the whole of the counter wall 51*b* on the first circuit substrate 32. For example, as shown in FIG. 7, the wiring section 38 may be arranged so as to surround three sides of the counter wall 51*b* except for one transverse side of the counter wall 51*b*. In this case, the same operational effect as in the above-described embodiment is also achieved.

[Second Embodiment]

Figure 8:
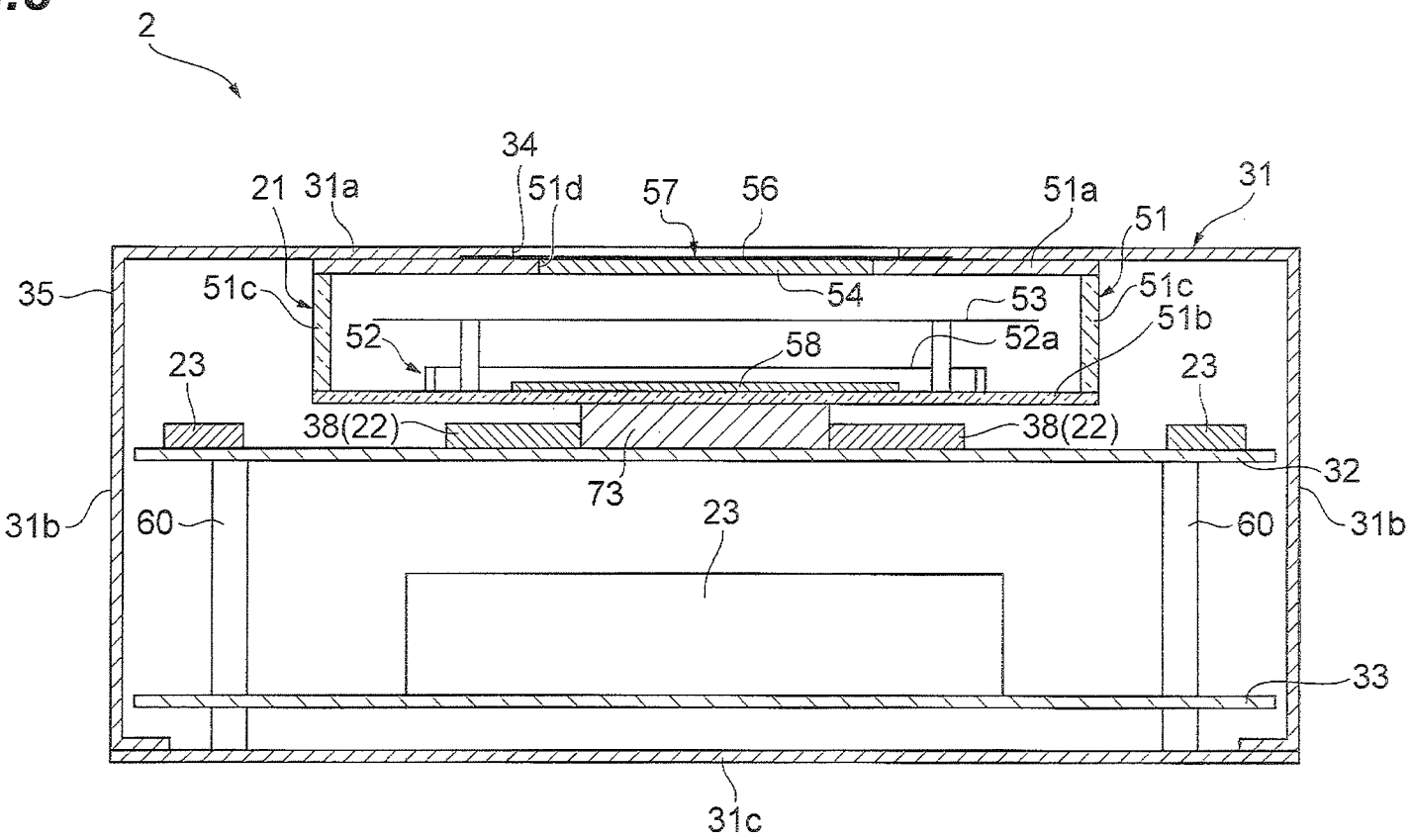
FIG. 8 is a cross-sectional view showing a coupling state between the X-ray tube and a circuit substrate in the X-ray radiation source according to the second embodiment of the present invention.

FIG. 8 is a cross-sectional view showing a coupling state between the X-ray tube and the circuit substrate in the X-ray radiation source according to the second embodiment of the present invention. As shown in the same drawing, the X-ray radiation source according to the second embodiment is different in the coupling state between the X-ray tube 21 and the first circuit substrate 32 and the arrangement of the high-voltage generation module 22 and wiring section 38 from the first embodiment.

More specifically, the present embodiment is so configured that a spacer 73 is arranged between the housing 51 of the X-ray tube 21 and the first circuit substrate 32, whereby the housing 51 of the X-ray tube 21 is separated from the first circuit substrate 32, while the housing 51 and the first circuit substrate 32 are coupled through the spacer 73. The spacer 73 is a block member made of an insulating material, e.g., silicone rubber. The spacer 73 is, for example, of a flat, substantially rectangular parallelepiped shape slightly smaller than the back electrode 58 and is bonded to each of substantially central regions of the counter wall Sib and the first circuit substrate 32. In the present embodiment, the high-voltage generation module 22 and the wiring section 38 are arranged in a gap made between the counter wall 51*b* and the first circuit substrate 32 by the spacer 73. The high-voltage generation module 22 and the wiring section 38 are provided in a rectangular frame shape so as to surround the spacer 73, in the thickness small enough to avoid contact with the counter wall 51*b*, on the first circuit substrate 32.

In this configuration, the counter wall 51*b* made of the alkali-containing glass, out of the walls of the housing 51 of the X-ray tube 21, is also arranged opposite to the high-voltage region VH of the power supply unit including the high-voltage generation module 22 which generates the negative high voltage to be applied to the filament 52. This prevents an electric field from being generated in the counter wall 51*b* and thus suppresses the precipitation of alkali ions from the glass. Therefore, it becomes feasible to suppress the change in the potential relationship between electrodes at different potentials such as the filament 52, grid 53, and target 54 and thus to prevent occurrence of the trouble of failure in maintaining the desired X-ray amount, thereby enabling stable operation to be maintained.

Since the spacer 73 allows the high-voltage generation module 22 and the wiring section 38 to be arranged in the gap made between the counter wall 51*b* and the first circuit substrate 32, while stably fixing the X-ray tube 21, the first circuit substrate 32 can be effectively utilized. This suppresses increase in the size of the first circuit substrate 32 and achieves downsizing of the X-ray radiation source 2. Furthermore, since the spacer 73 is made of the insulating material, it is also feasible to suppress electric effects on the counter wall 51*b*.

The spacer 73 may be silicone resin, urethane, or the like, or may be made of an electroconductive material. The coupling of the counter wall 51*b*, spacer 73, and first circuit substrate 32 is preferably implemented by a technique capable of securing adhesion between surfaces, such as a seal or adhesive. It is also preferred to use a material with a self-fusing property as the insulating material.

[Third Embodiment]

Figure 9:
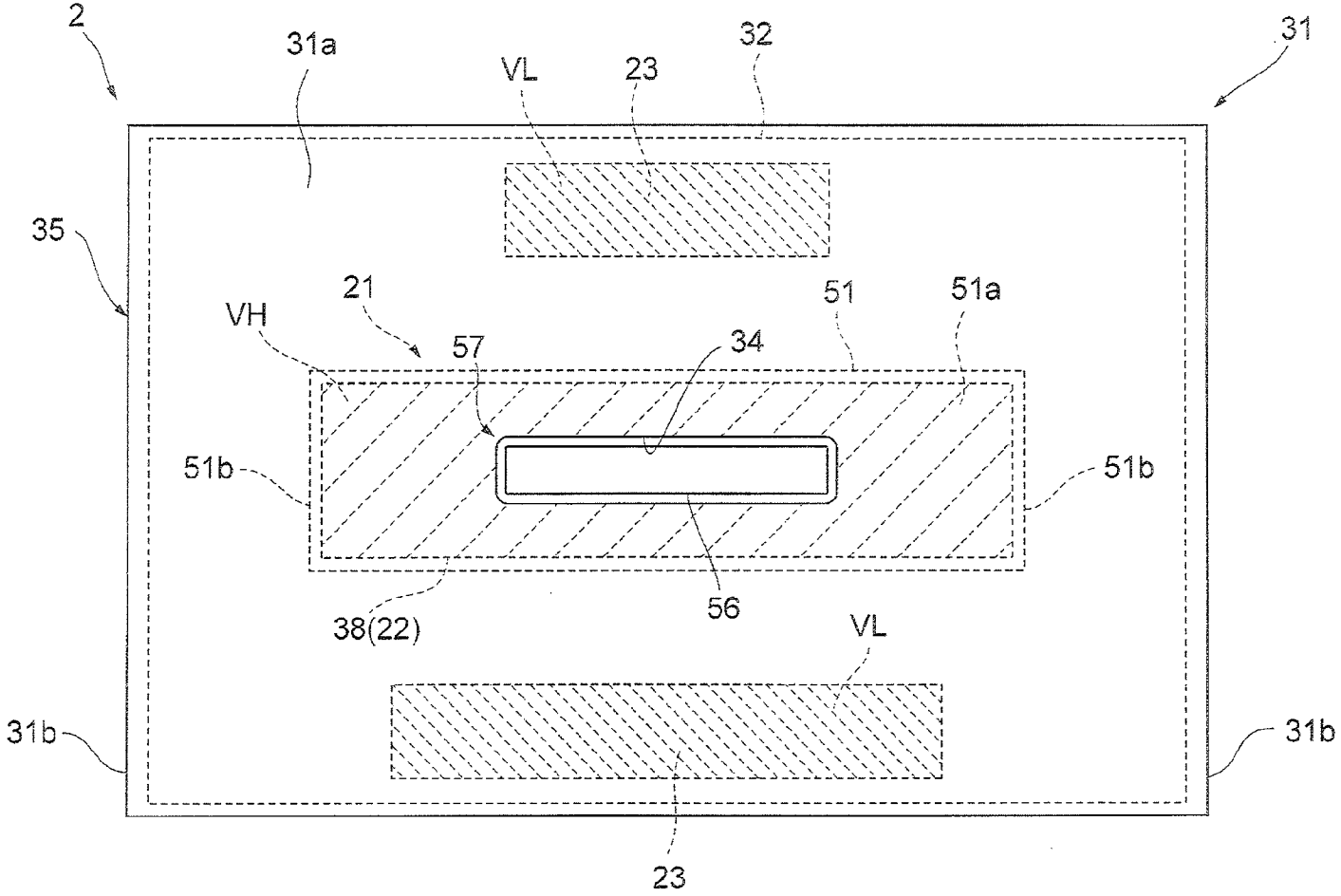
FIG. 9 is a plan view showing the X-ray radiation source according to the third embodiment of the present invention.
Figure 10:
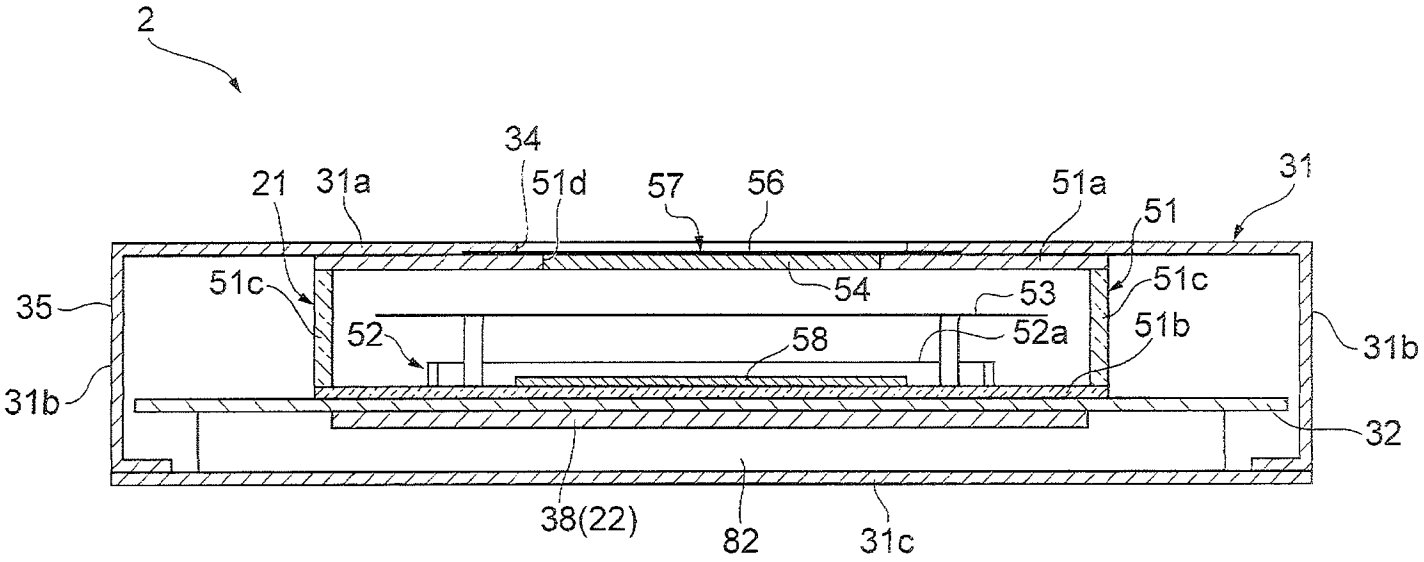
FIG. 10 is a cross-sectional view showing a coupling state between the X-ray tube and the circuit substrate in the X-ray radiation source shown in FIG. 9.

FIG. 9 is a plan view of the X-ray radiation source according to the third embodiment of the present invention. FIG. 10 is a cross-sectional view showing a coupling state between the X-ray tube and the circuit substrate. As shown in FIGS. 9 and 10, the X-ray radiation source according to the third embodiment is different in the coupling state between the X-ray tube 21 and the first circuit substrate 32 and the arrangement of the high-voltage generation module 22 and wiring section 38 from the first embodiment.

More specifically, the present embodiment uses the housing 31 and first circuit substrate 32 with the area larger than the first circuit substrate 32 shown in FIGS. 4 and 5, and the drive circuit 23 to drive the X-ray tube 21 is provided on both sides in the width direction of the X-ray tube 21 on one surface side of the first circuit substrate 32. Without use of the second circuit substrate 33, a spacer member 82 of a frame shape is fixed to the lid 31*c* and the first circuit substrate 32 is fixed to the top end of the spacer member 82. The high-voltage generation module 22 and the wiring section 38 are provided so as to face the counter wall 51*b*, on the opposite surface to the mounted surface of the housing 51 in the first circuit substrate 32.

In this configuration, the counter wall 51*b* made of the alkali-containing glass, out of the walls of the housing 51 of the X-ray tube 21, is also arranged opposite to the high-voltage region VH of the power supply unit including the high-voltage generation module 22 which generates the negative high voltage to be applied to the filament 52. This prevents an electric field from being generated in the counter wall 51*b* and thus suppresses the precipitation of alkali ions from the glass. Therefore, it suppresses the change in the potential relationship between electrodes at different potentials such as the filament 52, grid 53, and target 54 and thus prevents occurrence of the trouble of failure in maintaining the desired X-ray amount, thereby enabling stable operation to be maintained. In addition, the number of circuit substrates is reduced, to make the thickness of the housing 31 smaller and simplify the configuration around the housing 51.

[Test to Confirm Effect of Invention]

Figure 11:
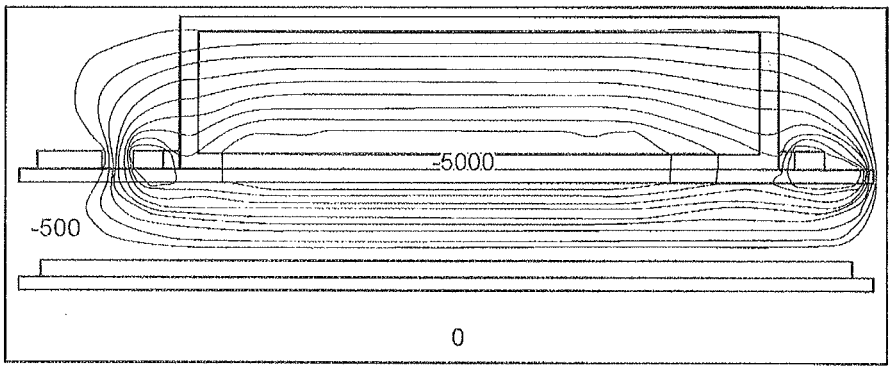
FIG. 11 is a drawing showing the result of a test to confirm the effect of the present invention, including (a) the result of Example 1 and (b) the result of Example 2.
Figure 11:
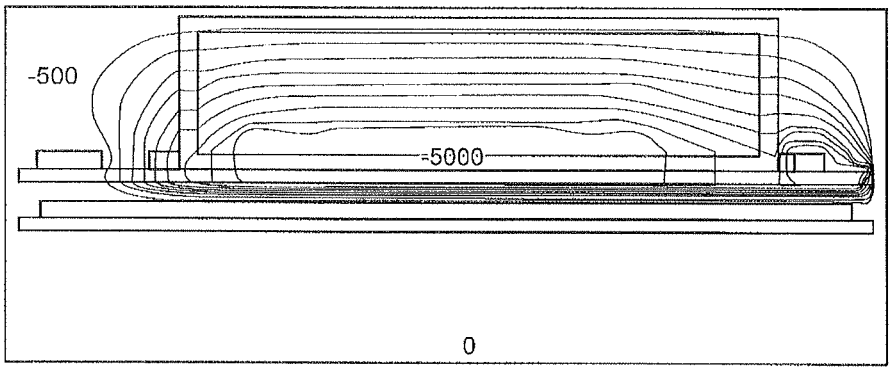

FIG. 11 is a drawing showing the result of a test to confirm the effect of the present invention. This test was carried out by simulation of a potential distribution around the housing of the X-ray tube, for an example wherein the wiring section forming the high-voltage region was arranged on the first circuit substrate so as to surround the counter wall (Example 1) and for an example wherein the wiring section forming the high-voltage region was arranged on the first circuit substrate so as to surround three sides of the counter wall except for one side thereof on the low-voltage region side (Example 2). It was assumed that in the both examples there were the high-voltage region around the counter wall and the low-voltage region separated from the high-voltage region, on the first circuit substrate and only the low-voltage region was located on the second circuit substrate. The second circuit substrate was located closer to the first circuit substrate in Example 2 than in Example 1.

As shown in FIG. 11 (*a*) and FIG. 11 (*b*), it was confirmed that, though a slight electric field was generated at the longitudinal ends of the counter wall in both of Example 1 and Example 2, no electric field was generated in the counter wall except for the foregoing regions. It was confirmed by this result that the generation of electric field in the counter wall was suppressed by arranging the counter wall of the X-ray tube in the high-voltage region as in the present invention.

REFERENCE SIGNS LIST

2 X-ray radiation source; 21 X-ray tube; 22 high-voltage generation module (power supply unit, high-voltage generation section); 32 first circuit substrate (circuit board); 38 wiring section (power supply unit); 51 housing; 51*a* window wall; 51*b* counter wall; 52 filament (cathode); 52*a* electron emission portion; 54 target; 57 output window; 58 back electrode; 73 spacer.

The invention claimed is:

1. An X-ray radiation source comprising:

an X-ray tube having a cathode to which a negative high voltage is applied, a target generating X-rays with incidence of electrons from the cathode, and a housing that houses the cathode and the target and having an output window to output the X-rays generated from the target, to the outside; and a power supply unit generating the negative high voltage to be applied to the cathode, wherein the housing has a window wall provided with the output window, and a main body portion joined to the window wall to form a housing space for housing the cathode and the target, wherein the main body portion has a counter wall arranged opposite to the window wall and made of alkali-containing glass, and wherein the power supply unit has a high-voltage generation section to generate the negative high voltage, and a high-voltage region connected to the high-voltage generation section and where the counter wall is arranged.

2. The X-ray radiation source according to claim 1, wherein the cathode extends along an inner surface of the counter wall, and wherein the high-voltage region extends along an extending direction of the cathode.

3. The X-ray radiation source according to claim 1, wherein an electron emission portion of the cathode is separated from the counter wall, wherein between the electron emission portion and the counter wall, a back electrode to which a negative high voltage substantially equal to the negative high voltage supplied to the cathode is applied from the power supply unit is provided, and wherein the back electrode is arranged to extend along an inner surface of the counter wall so as to face the cathode.

4. The X-ray radiation source according to claim 1, further comprising a circuit substrate on which the housing and the power supply unit are mounted, and comprising a wiring section to form the high-voltage region, wherein the high-voltage generation section and the wiring section are arranged so as to surround at least a part of the counter wall.

5. The X-ray radiation source according to claim 1, further comprising a circuit substrate on which the housing and the power supply unit are mounted, and comprising a wiring section to form the high-voltage region, wherein the housing is fixed to the circuit substrate through a spacer, and wherein the high-voltage generation section and the wiring section are arranged so as to surround at least a part of the spacer between the housing and the circuit substrate, at a position opposite to the counter wall.

6. The X-ray radiation source according to claim 1, further comprising a circuit substrate on which the housing and the power supply unit are mounted, and comprising a wiring section to form the high-voltage region, wherein the high-voltage generation section and the wiring section are arranged on the opposite surface side to a mounted surface of the housing in the circuit substrate, at a position opposite to the counter wall.

* * * * *